United States Patent [19]

Nohira

[11] 4,104,879

[45] Aug. 8, 1978

[54] SECONDARY AIR SUPPLY SYSTEM FOR AN INTERNAL COMBUSTION ENGINE

[75] Inventor: Hidetaka Nohira, Susono, Japan

[73] Assignee: Toyota Jidosha Kogyo Kabushiki Kaisha, Toyota, Japan

[21] Appl. No.: 679,448

[22] Filed: Apr. 22, 1976

[30] Foreign Application Priority Data

Dec. 26, 1975 [JP] Japan ..... 50-157477

[51] Int. Cl.[2] ..... F01N 3/10

[52] U.S. Cl. ..... 60/290

[58] Field of Search ..... 60/289, 290

[56] References Cited

U.S. PATENT DOCUMENTS

| | | | |
|---|---|---|---|
| 3,896,777 | 7/1975 | Masaki | 123/119 A |
| 3,927,524 | 12/1975 | Cholvin | 60/289 |
| 3,931,710 | 1/1976 | Hartel | 60/290 |
| 3,973,535 | 8/1976 | Sugihara | 123/119 A |
| 3,974,651 | 8/1976 | Nakajima | 60/290 |
| 3,996,739 | 12/1976 | Ono | 60/290 |

FOREIGN PATENT DOCUMENTS

| | | | |
|---|---|---|---|
| 1,930,412 | 2/1971 | Fed. Rep. of Germany | 60/290 |

*Primary Examiner*—Douglas Hart

*Attorney, Agent, or Firm*—Birch, Stewart, Kolasch & Birch

[57] ABSTRACT

A system for supplying secondary air into an exhaust system of an internal combustion engine in a manner such that the amount of secondary air is proportional to the engine intake air. The supply of the secondary air is controlled by a valve member which is biased in response to a balance between a venturi vacuum and the exhaust gas pressure until a predetermined ratio of the venturi vacuum to the exhaust gas is obtained.

8 Claims, 3 Drawing Figures

SECONDARY AIR SUPPLY SYSTEM FOR AN INTERNAL COMBUSTION ENGINE

BACKGROUND OF THE INVENTION

1. Field of the Invention

The present invention relates to a system for supplying secondary air into an exhaust system of an internal combustion engine for the purpose of purifying the exhaust gas discharged from the engine.

2. Description of the Prior Art

As a method of purifying exhaust gases discharged from an internal combustion engine, it is known to introduce secondary air into the exhaust system of the engine so as to recombust harmful components such as HC and CO contained in the exhaust gases. In order to obtain an optimum result from the secondary air injection in view of the degree of exhaust gas purification as well as to protect the hardware constituting the exhaust system of the engine, it is preferable that the amount of secondary air introduced into the exhaust system is controlled so that a predetermined constant ratio is maintained between the amount of engine intake air and that of the secondary air.

Since the amount of engine intake air is directly related to the venturi vacuum, it would be easy to control the supply of secondary air depending upon the venturi vacuum by employing a flow control valve adapted to be operated by said vacuum. However, since the venturi vacuum is proportional to the square of the amount of engine intake air, a relatively complicated control system is required to effect a non-linear modification between the amount to be controlled, i.e., the amount of secondary air, and a control signal, i.e., the venturi vacuum, if a linear relation is to be maintained between these two amounts throughout the entire operational region of the engine.

SUMMARY OF THE INVENTION

Therefore, it is the object of the present invention to provide a system for supplying secondary air into the exhaust system of an internal combustion engine by which the ratio of the amount of secondary air to that of engine intake air is constantly maintained at a predetermined value.

According to the present invention, the abovementioned object is accomplished by a system which supplies secondary air into an exhaust system of an internal combustion engine by a flow rate substantially proportional to that of exhaust gases. The system comprises a source of secondary air, a passage means for conducting secondary air from said source to said exhaust system of the engine, a secondary air control valve provided in the midst of said passage means for controlling the supply of secondary air to said exhaust system depending upon a control signal pressure supplied thereto, a pressure regulating valve for regulating said control signal pressure, said pressure regulating valve having a valve member which is positioned in accordance with a balance between a venturi vacuum and the exhaust gas pressure of the engine.

In a secondary air supply system of the abovementioned structure, a self closed control loop is formed to include the secondary air control valve, the pressure regulating valve and the engine intake and exhaust system as components thereof, said loop being automatically biased to establish a predetermined constant ratio of the venturi vacuum to the exhaust gas pressure, thereby providing a predetermined constant ratio of the amount of the secondary air to that of the engine intake air as explained in detail hereinafter.

According to a particular feature of the present invention, in view of the fact that the venturi vacuum is generally very small when compared with the exhaust gas pressure, a pressure amplifying means may preferably be provided in the midst of a passage means which supplies the vacuum pressure to said pressure regulating valve so as to amplify the venturi vacuum to a level comparable with the exhaust gas pressure thereby enabling a practical pressure balancing means such as a diaphragm means to effect the aforementioned balance between the venturi vacuum and the exhaust gas pressure of the engine.

According to another particular feature of the present invention, the pressure regulating valve for regulating said control signal pressure may be a duplex diaphragm means having two diaphragms connected with a common valve member. The first diaphragm being adapted to be applied with the venturi vacuum in a first direction while a second diaphragm is adapted to be applied with the exhaust gas pressure in a second direction opposite to said first direction. According to this arrangement the valve member is positioned or biased in accordance with a balance between the venturi vacuum and the exhaust gas pressure so as to regulate said control signal pressure which in turn biases the secondary air control valve which modifies the supply of control air until a predetermined constant ratio of the venturi vacuum to the exhaust gas pressure is obtained.

According to another particular feature of the present invention, the pressure regulating valve for regulating said control signal pressure may be a bleed valve which provides a bleed port located in the midst of the passage means transmitting said control signal pressure, said bleed port being selectively opened or closed in accordance with the positioning of said valve member.

According to still another particular feature of the present invention, said control signal pressure may be a vacuum taken from the intake manifold or, alternatively, the pressure of the secondary air supplied from the secondary air source.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
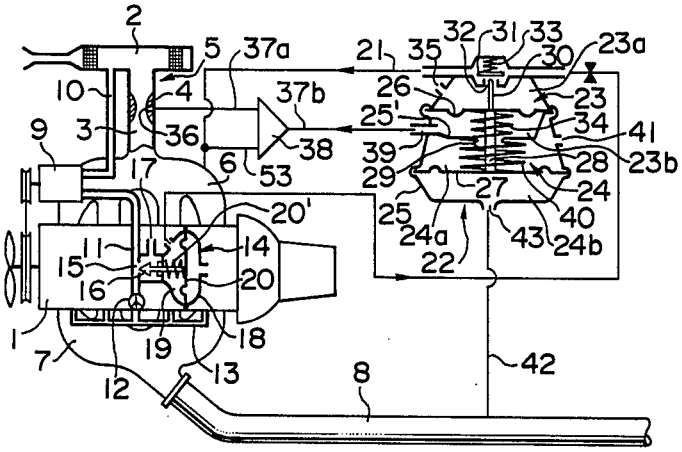
FIG. 1 is a schematical illustration of an internal combustion engine equipped with an embodiment of the secondary air supply system of the present invention.

Referring to FIG. 1, an internal combustion engine 1 is schematically shown as having an intake system for supplying a fuel-air mixture. The intake system includes an air cleaner 2, a carburetor 5 including an intake passage 3 and a venturi portion 4 and an intake manifold 6. The engine 1 discharges exhaust gases through an exhaust system including an exhaust manifold 7 and an exhaust pipe 8. The air cleaner 2 also supplies air to an air pump 9 which is provided with a source of secondary air through an air inlet pipe 10 connected to an outlet space of the air cleaner. The air pump 9 is driven by the engine 1. Air delivered by the air pump 9 flows through an air supply pipe 11 and a check valve 12, provided in the flow path of the pipe towards a manifold 13, wherefrom the air is divided by the branch pipes of the manifold and is thereafter supplied to the individual exhaust passages of individual cylinders of the engine so as to be injected into exhaust gases discharged from the individual exhaust ports. In the flow path of the secondary air supply passage defined by the. pipe 11, a secondary air control valve 14 is provided for the purpose of controlling the amount of secondary air to be supplied into the exhaust system of the engine. The secondary air control valve 14 comprises: a bleed port 15, which opens to the secondary air supply passage provided by the pipe 11; a valve member 16, adapted to control the opening of said bleed port; a discharge port 17, for discharging air bled through said bleed port to the atmosphere; a diaphragm housing 18; a diaphragm 20, which supports one end of the valve member 16 and defines a diaphragm chamber 19 together with said diaphragm casing; and a compression coil spring 20', which biases the diaphragm 20 and the valve member 16 supported thereby rightward as shown in FIG. 1 towards an operating mode of opening the bleed port. The diaphragm chamber 19 is supplied with an intake vacuum taken from the intake manifold 6 through a passage 21 under the control of a pressure regulating valve 22 provided in the flow path of the passage 21. Thus the diaphragm 20 may be biased leftward as shown in FIG. 1 against the action of the compression coil spring 20' in accordance with the vacuum applied to the diaphragm chamber.

The pressure regulating valve 22 regulates the vacuum applied to the diaphragm chamber 19 or in other words supplies a control signal pressure to the secondary air control valve 14. The pressure regulating valve 22 comprises a casing 25 which defines two chambers 23 and 24, the individual chambers being further divided into two chambers by first and second diaphragms 26 and 27. The two diaphragms are connected with a rod element 28 which movably passes through a central partition 25' while maintaining fluid tightness between the chamber 23 and 24 by means of a bellows 29. The rod element 28 is provided with a push rod at its upper end as shown in FIG. 1, said push rod being adapted to operate or bias a valve member 31 which controls a bleed port 32 provided in the flow path of the passage 21. The valve member 31 is biased by a compression coil spring 33 downward as shown in FIG. 1 to close the bleed port 32 and is urged upward by the push rod 30 being shifted upward as shown in FIG. 1 so as to selectively open the bleed port to the atmosphere thereby selectively introducing atmospheric air into the passage 21, thus reducing the vacuum applied to the diaphragm chamber 19.

The first diaphragm 26 is biased upward as shown in FIG. 1 by a first compression coil spring 34. A chamber **23*a* defined at the upper side of the first diaphragm 26 is connected with the bleed port 32 and is also opened to the atmosphere through an opening 35 thereby connecting the outlet of the bleed port 32 to the atmosphere. A chamber 23*b* defined at the underside of the first diaphragm 26 is supplied with a venturi vacuum taken from a vacuum port 36 provided at the venturi portion 4 of the carburetor 5. The actual venturi vacuum is taken from the port 36 and supplied through a passage 37*a* to a vacuum amplifier 38 which generates a secondary venturi vacuum amplified by a predetermined gain which is supplied through a passage 37*b* to a port 39 of the chamber 23*b***.

The second diaphragm 27 is biased downward as shown in FIG. 1 by a second compression coil spring 40. A chamber **24*a* defined at the upper side of the second diaphragm 27 is opened to the atmosphere through an opening 41 while a chamber 24*b* defined at the underside of the second diaphragm may be supplied with exhaust gas pressure through a passage 42 which connects the exhaust gas passage defined in the exhaust pipe 8 to a port 43 of the chamber 24*b***.

Figure 2:
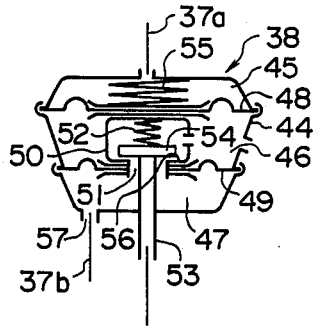
FIG. 2 is a schematical sectional view of an example of the pressure amplifying means to be incorporated into the secondary air supply system of the present invention; and, FIG. 3 is a schematical illustration similar to FIG. 1 showing another embodiment of the present invention.

The vacuum amplifier 38 is schematically shown in FIG. 2 as having a casing 44 which houses three chambers 45, 46 and 47 divided by first and second diaphragms 48 and 49. The two diaphragms are connected by a connecting element 50 which defines a bleed port 51 together with the second diaphragm 49 at a central portion thereof, said bleed port connecting the chambers 46 and 47 to each other. Within the connecting element 50 is positioned a valve member 54 supported by a tubular element 53 which in turn is connected with the casing 44, said valve member 54 being adapted to control the opening of the bleed port 51 as a combination of the first and second diaphragms 48 and 49 and the connecting element 50 is designated to move upward or downward as shown in FIG. 2. Character 52 designates a very weak compression coil spring acting between the connecting element 50 of the above-mentioned combination and the valve member 54 so as to bias said valve member downward toward a cooperating valve seat 56. Another compression coil springs 55 mounted in the chamber 45 biases the first diaphragm 48 of the above-mentioned combination downward as shown in FIG. 2 toward an operating mode which increases the opening of the bleed port 51. Communication between a passage defined by the tubular element 53, which corresponds to the passage designated by 53 in FIG. 1 and the passage **37*b*, corresponding to the passage designated by the same reference numeral in FIG. 1, is controlled by the cooperation of the valve member 54 with the upper end of the tubular element 53 and the valve seat 56. The chamber 45 is connected by the passage 37*a* (also shown in FIG. 1) to the vacuum port 36 of the venturi portion 4. In operation, when the venturi vacuum is applied to the chamber 45, the combination of the first and second diaphragms 48 and 49 and the connecting element 50 is biased upward thereby lifting the valve member 54 above the upper end of the tubular element 53 by an amount corresponding to the level of the vacuum applied to the chamber 45. In this manner, the passage 37*b*** provides a vacuum which is of a level substantially corresponding to that of the intake vacuum and modified corresponding to variations in the venturi vacuum.

The operation of the pressure regulating valve 22 is explained hereinafter.

If the effective pressure receiving area of the first and second diaphragms 26 and 27 are expressed by characters $A_1$ and $A_2$, respectively, the spring constant of the first and second compression coil springs 34 and 40 are expressed by characters $k_1$ and $k_2$, respectively, and deflection from a free condition of the first and second compression coil springs 34 and 40 in their assembled condition are expressed by characters $l_1$ and $l_2$, respectively, the following relation exists:

$$k_1 l_1 = k_2 l_2 \quad (1)$$

When the engine has started, the chamber **23*b* is first applied with the venturi vacuum $P_V$, i.e., the aforementioned secondary venturi vacuum which is the actual venturi vacuum $P_v$ multiplied by the gain $\alpha$ of the vacuum amplifier 38, whereby the rod element 28 is first shifted largely downward but, at the next moment, the chamber 24*b* is applied with the exhaust gas pressure $P_E$ whereby the rod element 28 is shifted back upward thereby causing a vibration of the moving system including the diaphragms 26, 27 and the rod element 28**. However, this vibration will be rapidly dampened due to the establishment of a balance between the venturi vacuum and the exhaust gas pressure. Under this balanced condition, the following equations are satisfied:

$$P_V A_1 + k_2 (l_2 - x) = P_E A_2 + k_1 (l_1 + x) \quad (2)$$

$$\therefore P_E = \frac{A_1}{A_2} P_V - x \frac{(k_1 + k_2)}{A_2} \quad (3)$$

Wherein $P_V$ and $P_E$ are expressed by their absolute (positive) value.

If it is assumed that the ratio of $A_1/A_2$ is properly determined in relation to a required ratio of $P_E$ to $P_V$, deflection $x$ becomes very small, and since the first and second compression coil springs may be selected to be of a very low strength which is only enough to maintain a minimum required stability of the diaphragm means in operation, the term $x\ (k_1 + k_2)/A_2$ is so small when compared with the term $(A_1/A_2)\ P_V$ that it is negligible. Therefore, equation (3) is approximately rewritten as follows:

$$P_E \approx (A_1/A_2)\ P_V \quad (3')$$

On the other hand, expressing the amount of the engine intake air by $G_a$ and that of the secondary air supplied to the exhaust system by $g_a$, the following relations exist:

$$P_V = C_1 G_a^2 \quad (4)$$

$$P_E = C_2 (G_a + g_a)^2 \quad (5)$$

Wherein $C_1$ and $C_2$ are constants.

Therefore, equation (3') is rewritten as follows:

$$C_2 (G_a + g_a)^2 = (A_1/A_2)\ \alpha\ C_1 \cdot G_a^2 \quad (6)$$

As a solution which absolutely satisfies this equation there exists the following condition:

$$g_a \propto G_a \quad (7)$$

Thus, the amount of secondary air $g_a$ is conditioned to be proportional to the amount of engine intake air $G_a$. The operation of the secondary air supply system according to the present invention is explained in a qualitative manner as follows:

If it is assumed that an increase in the amount of engine intake air has been effected thereby resulting in an increase in the venturi vacuum acting upon the underside of the first diaphragm 26 and this increase becomes relatively larger when compared with the exhaust gas pressure acting upon the underside of the second diaphragm 27, the result is a downward shifting of the rod element 28 thereby allowing the valve member 31 to be biased downward thereby reducing the opening of the bleed port 32. According to this reduction in the opening of the bleed port 32, the vacuum in the chamber 19 of the secondary air control valve 14 which is supplied through the passage 21 is correspondingly increased thereby causing a leftward shifting of the diaphragm 20 against the action of the compression coil spring 20' thereby driving the valve member 16 toward an operational mode in which the opening of the bleed port 15 provided in the secondary air passage 11 is reduced. This reduction in the bleed port 15 results in an increase in the amount of secondary air injected into the exhaust system. On the other hand, since the exhaust gas pressure increases in accordance with the increase in the amount of engine intake air as well as due to the increase in the amount of secondary air, this increased exhaust gas pressure shifts the moving system including the first and second diaphragms 26, 27 and the rod element 28 upward as shown in FIG. 1. The shifting upward movement of the moving system biases the valve member 31 upward via the push rod 30 thereby increasing the opening of the bleed port 32 thereby lowering the vacuum applied to the chamber 19 through the passage 21. A reduction in the vacuum in the chamber 19 is followed by a corresponding rightward shifting of the valve member 16 under the action of the spring force applied by the compression coil spring 20' thereby increasing the opening of the bleed port 15, thus reducing the amount of secondary air injected into the exhaust system of the engine. This vibrational movement of the assembly of the first and second diaphragms and the rod member is rapidly dampened to establish a new balanced condition wherein the rod element 28 or the valve member 16 takes a new position slightly different from the former position for a lower rate of engine intake air flow although the condition according to Equation (3') is still preserved thereby ensuring that the amount of secondary air injected into exhaust gases is constantly maintained to be proportional to the amount of engine intake air.

Figure 3:
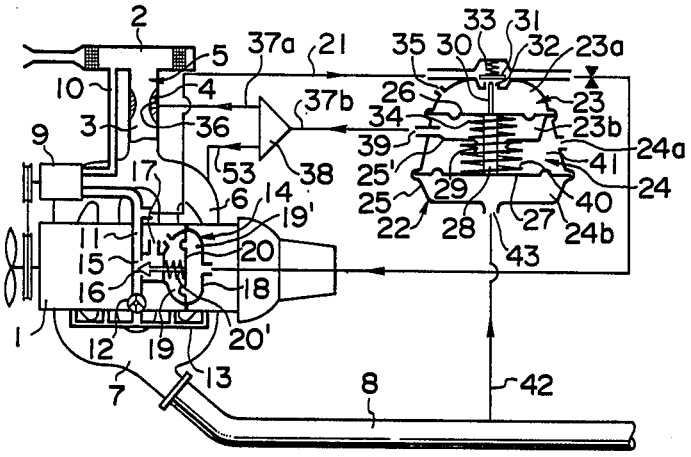

FIG. 3 is a view similar to FIG. 1 showing another embodiment of the present invention. In this embodiment an end of the passage 21 for conducting the control signal pressure is connected to the secondary air supply passage 11 so that the pressure of the secondary air is used as the pressure for controlling the secondary air control valve 14 according to the regulation applied by the pressure regulating valve 22. In this modification, the pressure regulating valve 22 is substantially the same as that incorporated in the system shown in FIG. 1 but the secondary air control valve 14 is slightly modified so that a positive control signal pressure is applied to a chamber 19' defined at the other side of the diaphragm 20 opposite to the chamber 19. This system operates in a similar manner as that shown in FIG. 1 so that as the assembly of the first and second diaphragms 26, 27 and the rod element 28 is shifted downward as shown in FIG. 3, an increased positive pressure is applied to the chamber 19' of the secondary air control valve 14 thereby biasing the diaphragm 20 leftwward as shown in FIG. 3 thereby reducing the bleed of secondary air through the bleed port 15 thus resulting in an increase in the amount of secondary air injected into the exhaust system of the engine.

In this system, the balance between the exhaust gas pressure and the venturi vacuum as expressed by equation (3') is also automatically established thereby effecting proportional injection of secondary air into the exhaust gas system according to the amount of engine intake air. In FIG. 3 the portions corresponding to those shown in FIG. 1 are designated by the same reference numerals and detailed explanation with respect to these portions is omitted for the purpose of simplicity.

Although this invention has been shown and described with respect to some preferred embodiments thereof, it should be understood by those skilled in the art that various changes and omissions in the form and detail thereof may be made therein without departing from the spirit and the scope of the invention, and all such modifications as would be obvious to one skilled in the art are intended to be included within the scope of the following claims.

I claim:

1. A system for supplying secondary air into an exhaust system of an internal combustion engine by a flow rate substantially proportional to that of exhaust gases, comprising:

a source of secondary air;

a passage means for conducting secondary air from said source to said exhaust system of the engine;

a secondary air control valve provided in the midst of said passage means for controlling the supply of secondary air to said exhaust system depending upon a control signal pressure supplied thereto;

a pressure regulating valve for regulating the pressure of said control signal pressure;

said pressure regulating valve having a valve member; and means positioning said valve member in accordance with a balance between a pressure representative of a carburetor venturi vacuum and the exhaust gas pressure of the engine.

2. The system of claim 1 further including a vacuum amplifying means which amplifies the venturi vacuum before it is supplied to said pressure regulating valve.

3. The system of claim 1, wherein said pressure regulating valve comprises a duplex diaphragm means including first and second diaphragms connected together with a common rod element, said first diaphragm being adapted to be biased in a first direction by the venturi vacuum while said second diaphragm being adapted to be biased in a second direction opposite to said first direction by the exhaust gas pressure, said common rod element actuating said valve member which regulates said control signal pressure.

4. The system of claim 3, wherein said valve member controls the opening of a bleed port which opens a passage of said control signal pressure to the atmosphere.

5. The system of claim 1, wherein said secondary air control valve comprises a diaphragm means adapted to be actuated by said control signal pressure and a valve member operated by said diaphragm means, said last mentioned valve member controlling the opening of a bleed port which opens said passage means for conducting secondary air to the atmosphere.

6. The system of claim 5, wherein said control signal pressure is vacuum in an intake manifold of the engine transmitted to said diaphragm means of the secondary air control valve under a regulation effected by said pressure regulating valve.

7. The system of claim 5, wherein said control signal pressure is pressure of said secondary air source transmitted to said diaphragm means of said secondary air control valve under a regulation effected by said pressure regulating valve.

8. The system of claim 2, wherein said vacuum amplifying means comprises a diaphragm means and a valve structure actuated by said diaphragm means, said diaphragm means being adapted to be biased by the venturi vacuum, and valve structure including a port which opens in the midst of a passage means for transmitting intake vacuum to said pressure regulating valve, wherein the opening of said port is controlled by a valve member in accordance with the biasing of said diaphragm means effected by variation in the venturi vacuum.

* * * * *